US009806833B2

(12) United States Patent
Martinez et al.

(10) Patent No.: US 9,806,833 B2
(45) **Date of Patent: *Oct. 31, 2017**

(54) SYSTEM AND METHOD FOR INSERTING BREAK-IN SIGNALS IN COMMUNICATION SYSTEMS

(75) Inventors: Michael G. Martinez, Long Beach, CA (US); Ramon S. Gallegos, Moreno Valley, CA (US); Luis Paulino Méndez-Badilla, Cartago (CR); Richard Picado-Hidalgo, Paraiso (CR); Victor Bermúdez-Mora, Curridabat (CR); Pablo Alvarado-Moya, Cartago (CR); Ronald Escalante-Pérez, Moravia (CR); Eugenio Salazar-Brenes, Cartago (CR); Marianita Alvarenga-López, Desamparados (CR)

(73) Assignee: CANAM TECHNOLOGY INCORPORATED, Long Beach, CA (US)

( * ) Notice: Subject to any disclaimer, the term of this patent is extended or adjusted under 35 U.S.C. 154(b) by 174 days.

This patent is subject to a terminal disclaimer.

(21) Appl. No.: 12/100,081

(22) Filed: Apr. 9, 2008

(65) Prior Publication Data

US 2009/0046616 A1 Feb. 19, 2009

Related U.S. Application Data

(63) Continuation of application No. 11/838,869, filed on Aug. 14, 2007.

(51) Int. Cl.
*H04H 20/59* (2008.01)

(52) U.S. Cl.
CPC ..... *H04H 20/59* (2013.01); *H04H 2201/70* (2013.01)

(58) Field of Classification Search
CPC ..... H04H 20/59; H04H 2201/70
(Continued)

(56) References Cited

U.S. PATENT DOCUMENTS 4,667,319 A 5/1987 Chum
5,357,542 A 10/1994 Suzuki
(Continued)

FOREIGN PATENT DOCUMENTS

CA 2049740 2/1993
EP 443933 8/1991
(Continued)

OTHER PUBLICATIONS

Wiatrowski, "Method of Providing Range Extension through Data Proxy", Motorola, Inc—2004.
(Continued)

*Primary Examiner* — Raymond Dean
(74) *Attorney, Agent, or Firm* — Loza & Loza, LLP; Julio Loza

(57) ABSTRACT

A system and method are provided for transmitting signals while facilitating channel-specific signal insertion to local user terminals. In one mode, a communication device may operate to transmit signals from a remote signal source (via a communication network infrastructure) to one or more local user terminals. In a second, the communication device may insert a locally-obtained break-in signal into one or more downlink communication channels, and/or bands, thereby providing the break-in signal to one or more specific local user terminals. In this manner, communications over a communication channel to a local user terminal may be interrupted by or mixed with an inserted break-in signal to the user terminal. Additionally, the communication device may also operate to establish bidirectional communications between a local operator and one or more user terminals as
(Continued)

well as relay communications between two or more local user terminals while bypassing the conventional network infrastructure.

16 Claims, 9 Drawing Sheets

(58) Field of Classification Search
USPC ..... 455/90.1, 404.1, 7–11.1, 14–25; 370/315, 312
See application file for complete search history.

(56) References Cited

U.S. PATENT DOCUMENTS

| | | | | |
|---|---|---|---|---|
| 5,526,376 | A | 6/1996 | Kellenberger | |
| 5,734,643 | A | 3/1998 | Rondeau | |
| 6,615,021 | B1 * | 9/2003 | Lovinggood et al. | 455/11.1 |
| 6,697,603 | B1 | 2/2004 | Lovinggood | |
| 6,873,823 | B2 | 3/2005 | Hasarchi | |
| 7,099,348 | B1 | 8/2006 | Warwick | |
| 7,683,792 | B2 * | 3/2010 | Araiza-Boys | 340/601 |
| 7,873,002 | B2 * | 1/2011 | Cai | 370/329 |
| 2002/0137458 | A1 | 9/2002 | Talwalkar | |
| 2003/0063607 | A1 * | 4/2003 | Adachi et al. | 370/389 |
| 2003/0114103 | A1 * | 6/2003 | Dinkel et al. | 455/17 |
| 2004/0125764 | A1 * | 7/2004 | Piwowarski et al. | 370/328 |
| 2005/0037728 | A1 * | 2/2005 | Binzel et al. | 455/404.1 |
| 2005/0276237 | A1 * | 12/2005 | Segal et al. | 370/312 |
| 2007/0117539 | A1 * | 5/2007 | Harris | 455/411 |
| 2007/0252688 | A1 * | 11/2007 | Eisold et al. | 340/506 |

FOREIGN PATENT DOCUMENTS

| | | |
|---|---|---|
| JP | 63274232 | 11/1988 |
| KR | 2004088903 | 10/2004 |

OTHER PUBLICATIONS

Puckette et al., "900 Mhz Private Radio Communication System—A Proposed Solution for Consumer Communication Needs".
Sielman, "A Single-Frequency Communications System", IEEE Transactions of Vehicular Technology, vol. VT-23, Feb. 1974.
Stolarczyk, "Emergency and Operational Low and Medium Frequency Band Radio Communications System for Underground Mines", IEEE Transactions on Industry Applications, vol. 27, Jul./Aug. 1991.
Hanysz, "Highway alert radio", IRE Transactions on Vehicular Communications, Aug. 1960.

* cited by examiner

SYSTEM AND METHOD FOR INSERTING BREAK-IN SIGNALS IN COMMUNICATION SYSTEMS

PRIORITY

This non-provisional U.S. patent application is a continuation application of, and claims priority on, non-provisional U.S. patent application Ser. No. 11/838,869 by Michael Martinez et al., titled "System And Method For Inserting Break-In Signals In Communication Systems", filed on Aug. 14, 2007, the contents of which is hereby incorporated by reference.

FIELD

The present invention relates to the field of communications, in particular, to the application of digital signal processing techniques to enable versatile break-in signal insertion (e.g., data and/or control signals) within selected communication channels of a communication system.

BACKGROUND

In some situations, it is desirable to communicate a message to a group of people within a defined geographical area or location. For instance, it may be desirable to warn people in a building to evacuate the building, or warn people in a city of an approaching tornado. While devices like sirens are sometimes employed for this purpose, these fail to provide detailed information about the situation, emergency, and/or actions to be taken. In other situations, it may be desirable to facilitate communications between different emergency response personnel (e.g., firefighters, police, paramedics, search and rescue, etc.) that use incompatible communication systems. For example, it may be desirable for emergency personnel responding to an emergency in a building to be appraised of the dangers and actions being taken by others within the building.

While most people and emergency responders now own and/or carry wireless communication devices (e.g., mobile phones, two-way radios, pagers, personal digital assistants, etc.), there is no convenient way for a local operator to contact one or more of these devices without going through a service provider.

In other emergency situations, for instance, in a hotel, it may be desirable to have the possibility to override a television signal sent through coaxial cables to some or all rooms, indicating the existence of an emergency and, possibly, replace the original transmission with an animation of the evacuation routes.

Consequently, a multi-channel communication device is needed that has channel-specific signal insertion to allow inserting data and/or control signals into one or more specific communication channels.

SUMMARY OF THE PRESENT INVENTION

One feature of the present invention provides a configurable communication device that permits channel-specific signal insertion with locally-obtained break-in signals into a communication stream in data and/or control channels. Communications over a communication channel (e.g., data and/or control signal channels) may be interrupted by an inserted break-in signal to a downlink user terminal. In one mode of operation, the communication device may operate to transmit or retransmit signals (e.g., voice communications, radio and television broadcasts, etc.) from a remote signal source (via a communication network infrastructure) to one or more recipient user terminals. In a second mode of operation, the communication device may insert a locally-obtained break-in signal into one or more downlink communication channels, and/or bands, thereby providing the break-in signal to one or more specific recipient user terminals.

Another feature enables the network communication device to initiate a communication channel with a local user terminal. Rather than interrupting an established communication link, the communication device may establish its own communication link with a local user terminal.

Yet another feature provides a network communication device that facilitates conference calling among a plurality of downlink local user terminals. That is, the communication device may utilize signal insertion into one or more downlink communication channels to send messages to one or more local user terminals. Additionally, the communication device may relay messages from an uplink communication channel (from a first user terminal) to one or more downlink communication channels (to other local user terminals).

One embodiment provides a configurable communication device comprising a receiving module, a channel distribution module, a first signal generator, a first channel processing module, a channel aggregation module, and/or a transmission module. The receiving module receives signals within a first frequency band. The channel distribution module may be coupled to the receiving module and configured to split the received signals into a plurality of communication channels. The first signal generator may provide a first break-in signal. The first channel processing module may be configured to (a) receive a first original signal on a first communication channel from among the plurality of communication channels, (b) pass content of the first original signal through the first communication channel if the first break-in signal is unavailable, (c) receive the first break-in signal from the first signal generator, and/or (d) insert the first break-in signal into the first communication channel for transmission. In various implementations, the first communication channel may be associated with a first user terminal and/or a plurality of user terminals. The channel aggregation module may be configured to combine outbound signals from the plurality of communication channels into a second frequency band. The transmission module transmits the outbound signals over a second frequency band. The first frequency band and second frequency band may be centered on the same frequency.

The communication device may further comprise a plurality of signal generators and a plurality of channel processing modules. The plurality of signal generators may provide a plurality of break-in signals. Each channel processing module may be configured to (a) receive an original signal on an associated communication channel from among the plurality of communication channels, (b) selectively pass content of the original signal through the associated communication channel if a break-in signal for the associated communication channel is unavailable, and/or (c) insert the break-in signal into the associated communication channel, if the break-in signal is available.

In an application of the invention in the field of mobile phone services, the first break-in signal may be inserted into an on-going telephone call between a third party and the first user terminal that utilizes the first communication channel. Alternatively, the first communication channel may be unused by the first user terminal when the break-in signal has to be transmitted, in which case a new communication channel can be established. In yet another application, inserting the first break-in signal into the first communication channel includes mixing the first break-in signal with a first original signal received on the first communication channel. Additionally, the break-in signal may include control signals. It may also be used to send location messages, SMS and other multimedia information.

In another example, the first break-in signal may be inserted into content transmitted through the first communication channel from a content provider to the first user terminal. The first communication channel may be uniquely associated with the first user terminal or it may be associated with a plurality of other user terminals that also receive the first break-in signal. Alternatively, at least some of the communication channels may be associated with different user terminals.

The communication device may also include a second receiving module for receiving signals from the first user terminal, thereby establishing bidirectional communications between the communication device and the first user terminal. Additionally, a processing circuit may be configured to relay the signals received from the first user terminal to other local user terminals.

A processing module is also provided, wherein the processing module is configured to (a) obtain a first signal comprising a plurality of different communication channels; (b) divide the first signal in a plurality of communication channels including a first downlink communication channel; (c) determine whether a break-in signal is ready to be inserted into the downlink communication channel; (d) insert the break-in signal (e.g., data and/or control) into the first downlink communication channel if the break-in signal is ready for insertion; (e) pass content of an original signal received in the downlink communication channel through the first downlink communication channel if no break-in signal is inserted; and/or (f) combine content of the first downlink communication channel and signals in the remaining plurality of communication channels into a frequency band for transmission. The processing circuit may also (g) identify the first downlink communication channel associated with a first user terminal to target the break-in signal to the first user terminal, and/or (h) receive a signal from the first user terminal on an associated first uplink communication channel. Transmission of the second signal message may be broadcasted to a plurality of recipient user terminals listening on the first downlink communication channel. The break-in signal may be generated from a pre-recorded message source, an external source, or a live-acquired message source.

A method is provided for overriding signaling and/or multimedia signals in a configurable communication device. A first signal is obtained comprising a plurality of communication channels. The first signal is divided into its plurality of communication channels including a downlink communication channel. A break-in signal (e.g., data and/or control signals) is inserted into the downlink communication channel if the break-in signal is ready for insertion. Content of an original signal received in the downlink communication channel is passed through the downlink communication channel if no break-in signal is ready for insertion. Content of the downlink communication channel and signals in the remaining plurality of communication channels are combined into a frequency band for transmission. The break-in signal may be broadcasted to a plurality of recipient user terminals listening on the downlink communication channel. The break-in signal may provide information specific to one or more of the plurality of recipient user terminals. The break-in signal may replace or be mixed with original signals in a plurality of downlink communication channels associated with a plurality of user terminals with information selected specifically for the plurality of downlink communication channels.

Insertion of the break-in signal may include (a) identifying a downlink communication channel modulation; (b) determining an insertion mode for inserting the break-in signal into the downlink communication channel; and/or (c) inserting the break-in signal into the channel according to the identified modulation for the downlink communication channel and insertion mode.

The foregoing, together with other features and advantages of the present invention, will become more apparent when referring to the following specification, claims and accompanying drawings.

BRIEF DESCRIPTION OF THE DRAWINGS

Various features of the present invention will be better understood from the following detailed description of an exemplary embodiment of the invention, taken in conjunction with the accompanying drawings in which like reference numerals refer to like parts.

DETAILED DESCRIPTION OF THE INVENTION

Figure 1:
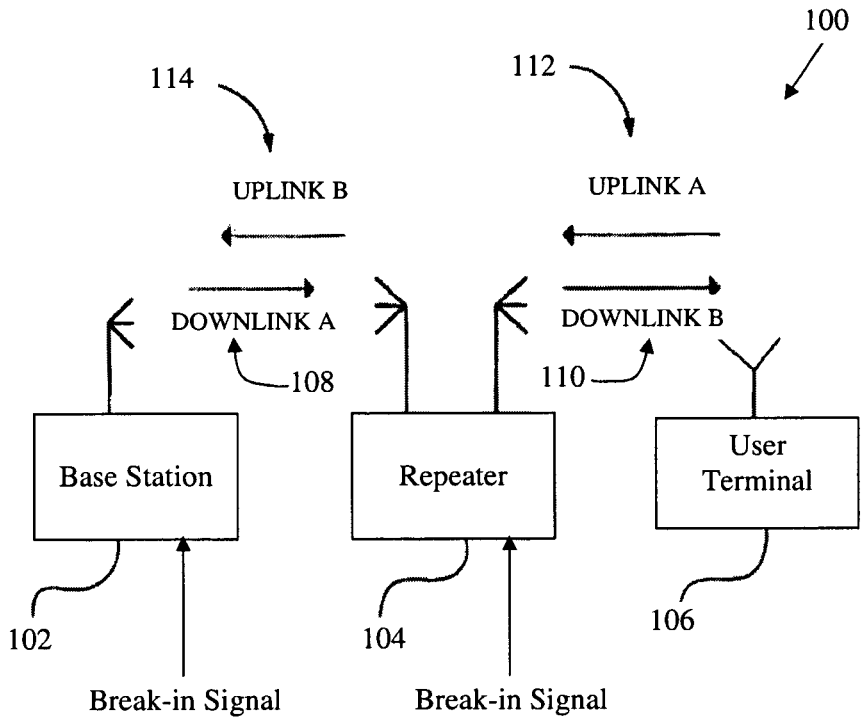
FIG. 1 is a block diagram illustrating a communication system in which one or more communication devices may provide localized signal insertion into one or more communication channels.

In the following detailed description of the invention, numerous specific details are set forth in order to provide a thorough understanding of the invention. However, the invention may be practiced without these specific details. In other instances well known methods, procedures, and/or components have not been described in detail so as not to unnecessarily obscure aspects of the invention.

Also, it is noted that the embodiments may be described as a process that is depicted as a flowchart, a flow diagram, a structure diagram, and/or a block diagram. Although a flowchart may describe the operations as a sequential process, many of the operations can be performed in parallel or concurrently. In addition, the order of the operations may be rearranged. A process is terminated when its operations are completed. A process may correspond to a method, a function, a procedure, a subroutine, a subprogram, etc. When a process corresponds to a function, its termination corresponds to a return of the function to the calling function or the main function.

Moreover, a storage medium may represent one or more devices for storing data, including read-only memory (ROM), random access memory (RAM), magnetic disk storage mediums, optical storage mediums, flash memory devices, and/or other machine readable mediums for storing information. The term "machine readable medium" includes, but is not limited to portable or fixed storage devices, optical storage devices, wireless channels, and various other mediums capable of storing, containing, or carrying instruction(s) and/or data.

Furthermore, embodiments may be implemented by hardware, software, firmware, middleware, microcode, hardware description language (HDL) (e.g., Verilog or VHDL), and/or a combination thereof. When implemented in software, firmware, middleware, or microcode, the program code or code segments to perform the necessary tasks may be stored in a machine-readable medium such as a storage medium or other storage means. A processor may perform the necessary tasks. A code segment may represent a procedure, a function, a subprogram, a program, a routine, a subroutine, a module, a software package, a class, or a combination of instructions, data structures, or program statements. A code segment may be coupled to another code segment or a hardware circuit by passing and/or receiving information, data, arguments, parameters, or memory contents. Information, arguments, parameters, data, and the like, may be passed, forwarded, or transmitted via a suitable means including memory sharing, message passing, token passing, and network transmission, among others.

The term "communication system" refers to a physical device capable of receiving and/or transmitting wired or wireless signals, such as voice and/or data signals or messages. The term "user terminal" refers to any device, such as a mobile phone, pager, personal digital assistant, radio, etc., that can send and/or receive signals from a communication system. The terms "break-in signal", "insertion signal", and "inserted signal" are interchangeably used to refer to signals that are inserted into a channel at a network communication device. The "break-in signal", "insertion signal" and "inserted signal" may be a data signal, a control signal, or both. The term "channel" refers to a frequency, frequency band, time slot, modulation schemes (e.g., orthogonal codes, etc.), etc., that define a communication link.

One feature provides a configurable network communication device (e.g., base station, repeater, etc.) for use in transmitting wired and/or wireless signals while facilitating channel-specific signal insertion. For example, such communication system may be a base station, repeater, relay station, etc., that includes hardware and/or software components that facilitate analog and/or digital one-way and/or two-way communications with local user terminals. According to one aspect of the invention, communications over a communication channel may be interrupted by a break-in signal to a downlink user terminal. In one mode of operation, the communication device may operate to transmit or retransmit signals (e.g., voice communications, radio or TV broadcasts, etc.) from a remote signal source (via a communication network infrastructure) to one or more recipient user terminals. In a second mode of operation, the communication device may insert a locally-obtained break-in signal into one or more downlink communication channels, and/or bands, thereby providing the break-in signal to one or more specific recipient user terminals. In a second aspect of the invention, the break-in signal may be mixed at any desired ratio with an original signal in a communication channel, including pass-through or complete override of the original signal.

Another feature enables the network communication device to initiate a communication channel with a local user terminal. Rather than interrupting an established communication link, the communication device may establish its own communication link with a local user terminal. Signal insertion at the communication device over a downlink communication channel facilitates sending messages to a specific user terminal. Similarly, the communication device may monitor an uplink communication channel from the specific user terminal to receive messages from the user terminal.

Yet another feature provides a network communication device that facilitates conference calling among a plurality of downlink local user terminals. That is, the communication device may utilize signal insertion into one or more downlink communication channels to send messages to one or more local user terminals. Similarly, the communication device may monitor one or more uplink communication channels from the user terminals to receive messages from the user terminals. Additionally, the communication device may relay messages from an uplink communication channel (from a first user terminal) to one or more downlink communication channels (to other local user terminals).

FIG. 1 is a block diagram illustrating a communication system 100 in which one or more communication devices may provide localized signal insertion into one or more communication channels. Such localized signal insertion may also be interchangeably referred to as signal "break-in". In this example, both a base station 102 and a bi-directional repeater 104 may provide break-in signal insertion to one or more channels passing through them. While this example may describe signal insertion as being performed by the repeater 104, it should be clearly understood that signal insertion may also occur at the base station 102 or any other network communication device carrying signals to a user terminal 106.

The repeater 104 may implement either unidirectional or bidirectional communication paths to and/or from the user terminal 106. For example, the repeater 104 may provide a downlink path 108 and 110 for communications from the base station 102 to the user terminal 106. Likewise, the repeater 104 may also provide an uplink path 112 and 114 for communications from the user terminal 106 to the base station 102. In one implementation, the repeater 104 may receive wireless signals and retransmit stronger versions of such signals. The repeater 104 may be deployed at or near buildings, tunnels, subways, valleys and/or other places where extending coverage of wireless signals would be useful.

The communication system 100 may operate in one or more signal modulation and/or spectrum management schemes and/or communication standards, such as Code Division Multiple Access (CDMA), Global System for Mobile Communications (GSM), Time Division Multiple Access (TDMA), Terrestrial Trunked Radio (TETRA), Specialized Mobile Radio (SMR), Integrated Digital Enhanced Network (iDEN), Frequency Modulated radio (FM), Amplitude Modulated radio (AM), among others. In some wireless communication systems, uplink transmissions from the user terminal 106 (e.g., mobile phone, personal digital assistant, pager, etc.) to a base station 102, may be implemented on different channels (e.g., frequency bands) than downlink transmissions from the base station 102 to the user terminal 106. For example, the 825-845 MHz frequency band may be used for uplink 112 and 114 transmissions and the 870-890 MHz frequency band may be used for downlink transmissions 108 and 110. The downlink and uplink frequency bands may be segmented into communication channels (e.g., 30 kHz wide); with one or more uplink channels and one or more downlink channels selected to carry communications between the base station 102 and user terminal 106. In other example, the uplink and/or downlink channels may be defined by timeslots within a frequency band.

The repeater 104 may provide a flexible and cost effective way to extend the range of coverage or fill coverage gaps between the base station 102 and the user terminal 106 (e.g., cellular handset, radio receiver, etc.) in wireless communications systems. Generally, the repeater 104 is configured to receive a wireless signal, increase its strength, and retransmit it on the same frequency to its intended recipient. While the repeater 104 may preserve the frequency, stability and/or quality of the original over-the-air signal from the base station 102, it may do so without demodulating the content in the received signals. Instead, the repeater 104 may digitally process signals in a particular channel and amplify them prior to retransmission. The repeater 104 may be band-oriented, channel-oriented or sub-band-oriented. The band-oriented approach retransmits all channels in a frequency band. The channel-oriented approach retransmits selected communication channels. The subband-oriented approach retransmits a section of a frequency band.

The repeater 104 may be pre-configured or configured on-site and may be used with various platforms, including but not limited to, base stations, on-frequency repeaters (OFR), broadband boosters, and/or narrow-band boosters. For example, the repeater 104 may be used as a multi-channel signal booster for rebroadcast of commercial AM and/or FM radio signals (one-way communications) (including European DAB and HD IBOC) in enclosed/covered areas with weak signals, as well as in multi-channel signal booster systems for land mobile radio (two-way radio) narrow-band applications (e.g., 15 kHz and 7.5 kHz channel bandwidths).

In one mode of operation, the repeater 104 may receive, filter, and/or amplify one or more selected frequency bands, sub-bands, and/or specific communication channels and retransmit them. In a second mode of operation, the repeater 104 enables insertion of break-in multimedia signals (e.g., a voice message, text, graphics, video, a marker-tone, and/or alert) into one or more data and/or control channels. For example, an emergency break-in signal (locally-generated at or near the repeater 104) may be sent to user terminals being served by the repeater 104. The inserted break-in signal may be a locally-obtained independent message (e.g., pre-stored, generated real-time, etc.) that replaces the original signal in a communication channel or is mixed with the original signal in a channel. For example, the break-in signal may be mixed at any desired ratio with an original signal in a communication channel, including pass-through or complete override of the original signal. In an alternative implementation, the break-in signal may be inserted into an unused existing channel and/or newly allocated channel, and does not replace or mix with an existing signal in that channel.

The repeater 104 may be installed in a building or tunnel, for example, to help signal reception. The signal insertion feature may allow an operator of the building or tunnel to send inserted or break-in signals to alert people in the building or tunnel about an emergency or other situation. For instance, for a person using a mobile phone that communicates through the repeater 104, the break-in or inserted signal (e.g., carrying emergency evacuation information specific to the building, tunnel, and/or user) may be inserted into the communication channel being used by the mobile phone. In one example, such localized inserted signal may be a voice message that interrupts or is inserted into a user's call. Similarly, the inserted signal may be inserted into an FM or AM radio frequency channel(s) to notify radio listeners within the building or tunnel of some occurrence (e.g., provide evacuation instructions, etc.). Because the break-in or inserted signal is locally generated or even generated for specific user terminals, it can include specific information about the building or tunnel that cannot be otherwise conveyed by a conventional alarm. For instance, a particular evacuation path may be conveyed.

Figure 2:
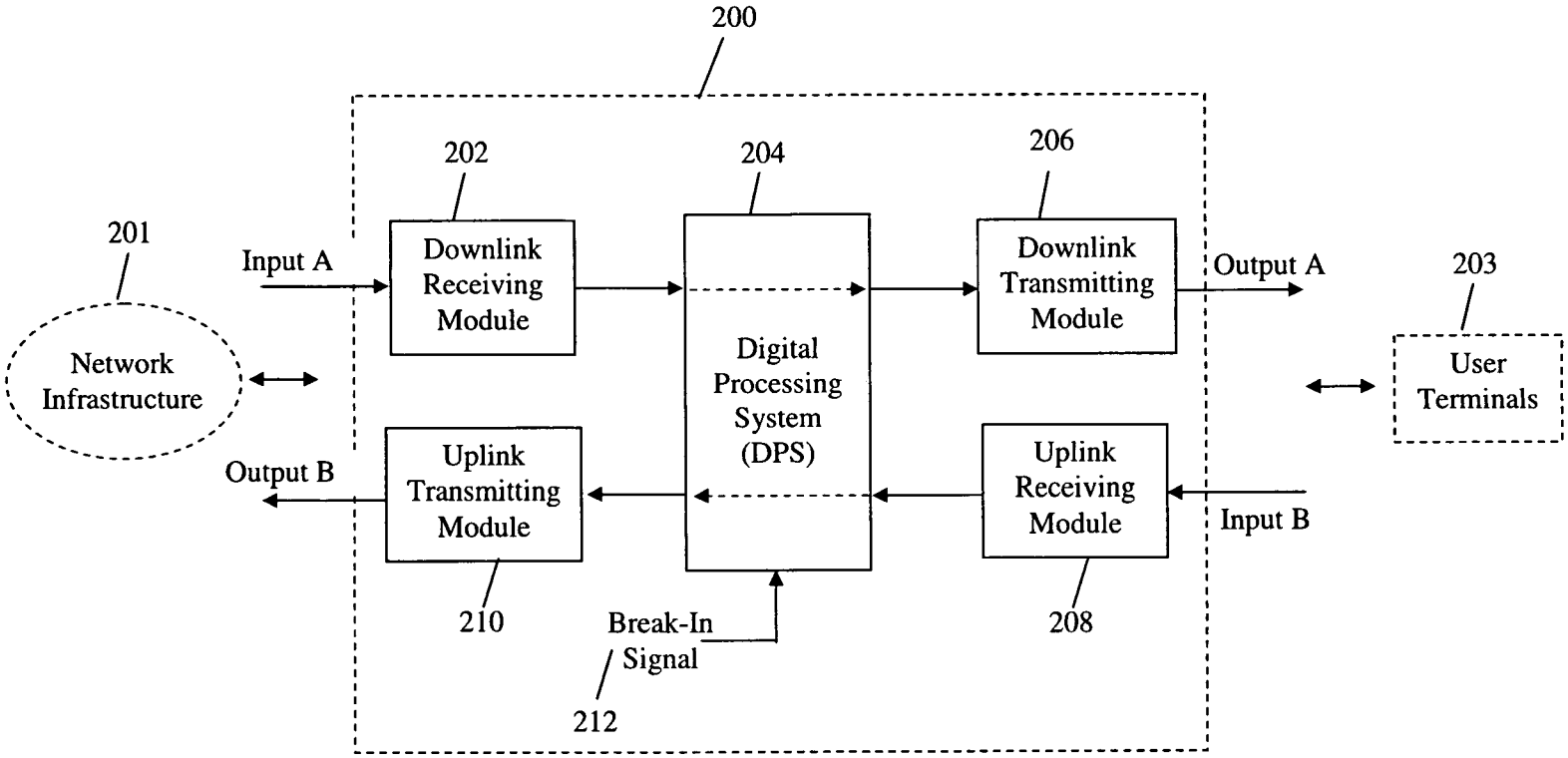
FIG. 2 is a block diagram of one example of a communication device configured to facilitate channel-specific signal insertion.

FIG. 2 is a block diagram of one example of a communication device configured to facilitate channel-specific signal insertion. The communication device 200 may operate between a communication network infrastructure 201 and one or more user terminals 203 to deliver multimedia and control signals (voice, video, text, and/or data) between the network 201 and the one or more local user terminals 203. In this example, the communication device 200 may be a repeater that includes a downlink receiving module 202, a digital processing system (DPS) 204, and a downlink transmitting module 206. The downlink receiving module 202 may receive one or more analog signals (Input A, a multi-channel carrier signal or a frequency band). Optionally, the receiving module 202 may convert selected frequencies of the radio frequency signal to an intermediate frequency (IF). Next, the DPS 204 converts the one or more received analog signals to digital signals, splits the digital signals into multiple channels, amplifies the signals in a selection of the multiple channels, and recombines the channel selection for retransmission. The digital signals are converted back to one or more analog signals and passed to the downlink transmitting module 206 for transmission (Output A). Optionally, the downlink transmitting module 206 may up convert the frequencies of the selected analog signals to an intermediate frequency (IF)

Similarly, the repeater 200 may provide a reverse amplification path with an uplink receiving module 208 that receives analog signals (Input B) that are converted to digital signals by the DPS 204, amplified, and retransmitted as analog signals by an uplink transmitting module 210. The output signals may be centered at substantially the same frequency as the corresponding input signals.

The DPS 204 is able to receive and/or generate a break-in signal 212 and insert it into one or more specific communication channels. For example, a voice message can be inserted into a particular communication channel by interrupting a digital voice signal in that channel and replacing it with a digital version of the break-in signal 212. The digital break-in signal is then combined with the other digital signals (in other communication channels) into a single digital signal and provided to the transmitting module.

One advantage of the present invention is that the communication device 200 allows a local operator (e.g., building manager, campus supervisor, local fire department, etc.) to override communications with local or nearby user terminals to provide specific messages (e.g., warnings, alerts, safety instructions, etc.).

Note that while the communication device 200 is illustrated as having bidirectional communication paths (uplink and downlink paths), the communication device may also be a unidirectional device. Moreover, signal insertion may be performed on either a single direction (e.g., a downlink path to a user terminal) or in both directions (e.g., uplink and a downlink paths). Additionally, in some implementations, the analog signal may be directly digitized if its bandwidth and frequency limits permit it. Moreover, the input and output signals to and/or from the communication device 200 may be received from and/or transmitted via wired and/or wireless transmission mediums.

Figure 3:
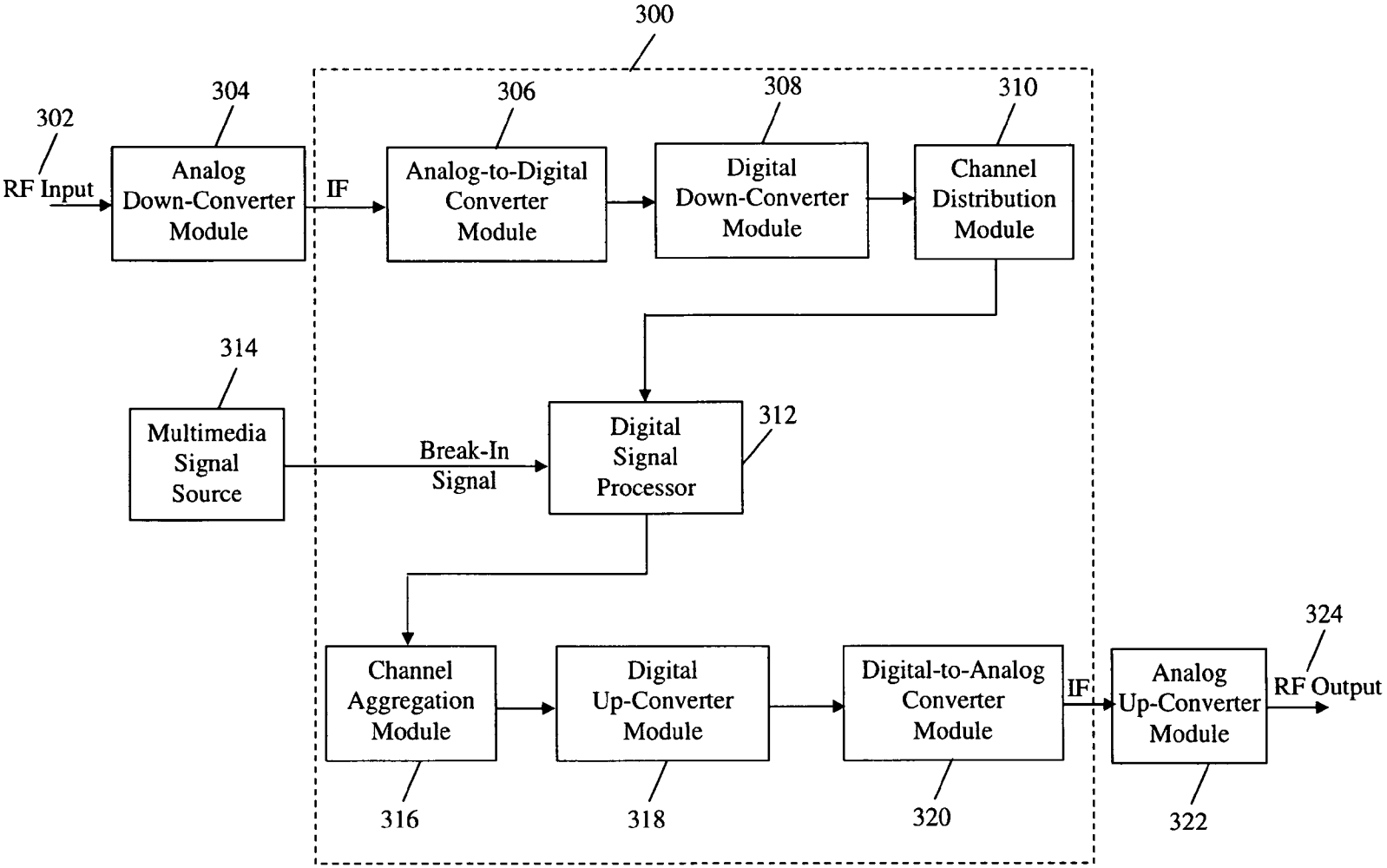
FIG. 3 is a functional block diagram illustrating an example of a digital processing system that facilitates channel-specific signal insertion in a communication system.

FIG. 3 is a functional block diagram illustrating an example of a digital processing system that facilitates channel-specific signal insertion in a communication system. An analog RF input signal 302 is received, down-converted to an intermediate frequency (IF) by an analog down-converter module 304, converted to a digital signal by an analog-to-digital converter module 306. In other implementations, the analog RF input signal 302 need not be down converted but rather may be converted in-band to the digital signal. The digital signal may be down converted by a digital down-converter module 308 and separated into different communication channels by a channel distribution module 310. A digital signal processor 312 may then amplify each digital channel independently. That is, original signals received in each digital channel may be independently processed (e.g., amplified, attenuated, filtered, etc.). Additionally, the digital signal processor 312 may also obtain or generate a break-in or inserted signal (in digital form) from a multimedia signal source 314. Such multimedia signal source 314 may be capable of generating break-in signals (e.g., voice messages, text messages, video content, tones, graphic content, and/or control signals). If a break-in signal is available for insertion, the break-in signal may be inserted into one or more specific digital channels, thereby replacing or mixing with the original digital signal in that digital channel. Otherwise, the content of the original signal in the digital channel may be passed through the digital channel. The digital signal processor 312 may process the plurality of digital channels in parallel or in series. Additionally, the digital signal processor 312 may perform signal insertion in some channels while allowing original signals in other channels to pass. The digital signals in the different digital communication channels are then combined by a channel aggregation module 316 into one or more signals which are then digitally up converted by a digital up-converter module 318. The aggregated digital signal(s) is then converted to one or more analog signals by a digital-to-analog converter module 320 and further up converted by an analog up converter module 322 and retransmitted as a RF output signal 324. The output signal 324 may transmit on substantially the same frequency band as the received input signal 302.

The digital signal processor 312 may be configured to filter each channel, amplify signals in each channel, and, if break-in of a particular channel or band is requested, insert break-in signal into the specified channel(s) or band(s). Upon determination that a break-in signal is to be inserted in a channel, the digital signal processor 312 may analyze, interpret, and/or manipulate the time, frequency, and/or power properties (e.g., modulation) of signals in the channel for proper insertion of the override signal.

Figure 4:
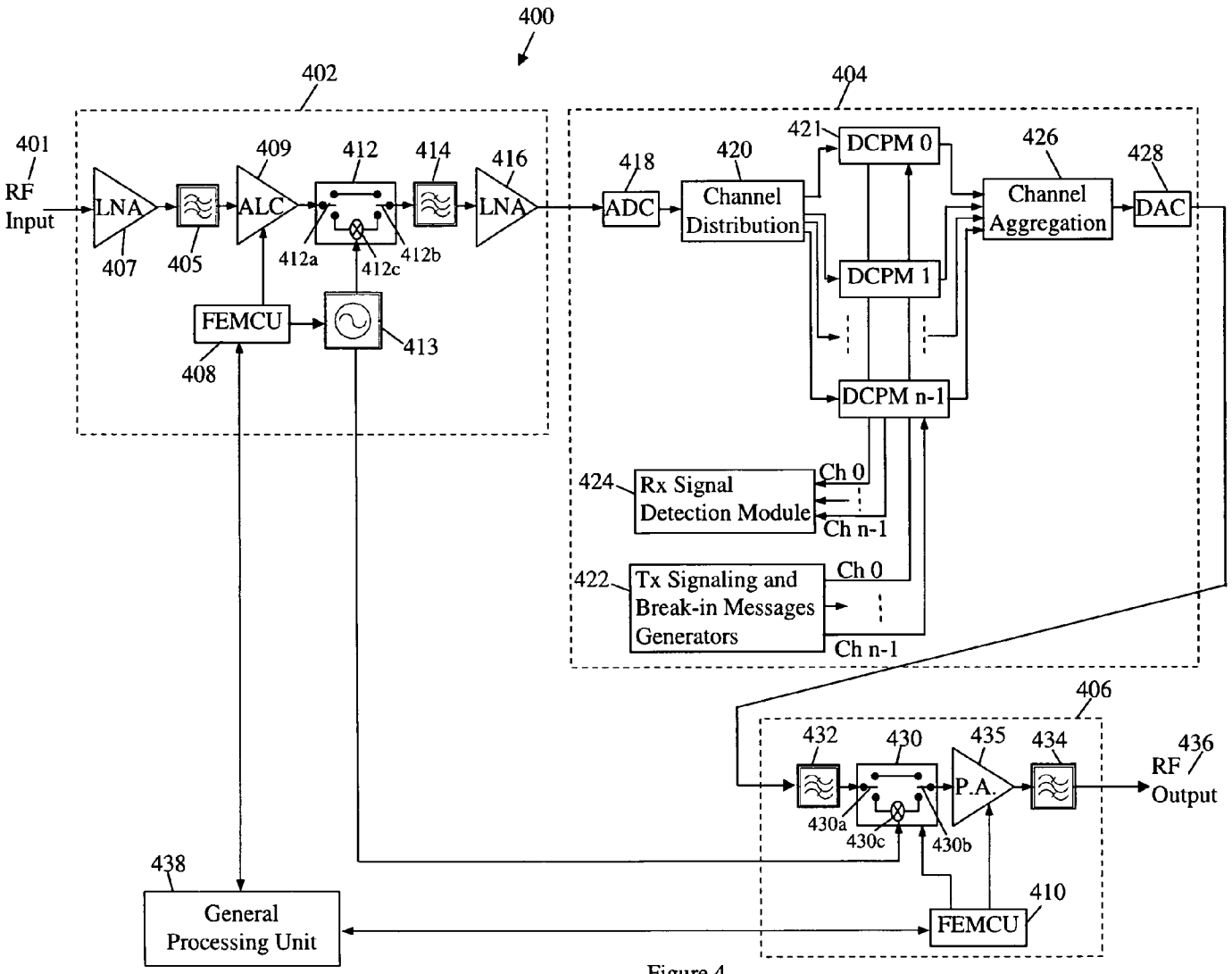
FIG. 4 illustrates a detailed block diagram of an example of a configurable communication device with channel-specific signal insertion.

FIG. 4 illustrates a detailed block diagram of an example of a configurable communication device 400 with channel-specific signal insertion. In this example, the communication device 400 includes a RF front-end interface 402 for preparing input analog signals for digital conversion, a digital processing system (DPS) 404 for providing versatile digital signal processing and analysis capabilities, and a RF back-end interface 406 for preparing the resulting signals for retransmission. The analog front-end interface 402 and the RF back-end interface 406 provide a high purity spectrum output with high-linearity and high power-efficiency features. In some embodiments, a general processing unit 438 may control the operation of the interfaces 402 and 406 and the DPS 404. One advantage of this architecture is that the receiver front-end and back-end interfaces 402 and 406 allow for effectively receiving and re-broadcasting a large number of communication channels, even the weaker ones, in typical metropolitan urban areas with high density of radio spectrum saturation.

The RF front-end interface 402 is digitally controlled by a front-end micro-controller unit (FEMCU) 408, and the RF back-end interface 406 is digitally controlled by a back end micro-controller unit (BEMCU) 410. The FEMCU 408 and the BEMCU 410 may also allow external interfacing with monitoring systems and graphical user interfaces (GUI) that can be local or network based. Both micro-controllers 408 and 410 are managed by the general processing unit 438.

The RF front-end interface 402 receives analog input signals 401 which are enhanced with a first low-noise amplifier (LNA) 407. The amplified signals are passed through a band-pass pre-selector (BPP) 405 for selecting the frequency band to be processed. From the BPP 405, the signals are power limited with an automatic level controller (ALC) 409.

In one aspect of the present invention, a first optional mixer 412*c* may be utilized, after the ALC 409, to select between a first and a second operational mode using a selector 412*a*. If the first operational mode is selected, in-band passing of the signals occurs through path 412*b*. If the second operational mode is selected, a frequency translator in path 412*c* is used to center the frequency band on an Intermediate Frequency (IF) provided by an oscillator 413. Next, the signals are filtered for band-width limitation using a band-pass filter 414.

The signals are then enhanced by passing through a second LNA 416 prior to passing to an analog-to-digital converter (ADC) 418 in the DPS 404. Utilizing a high-speed/high-dynamic range ADC 418 digitizes the signals into a data stream for processing and analysis in the DPS 404.

The DPS 404 includes a channel distribution module 420 that splits the digital signal(s) into multiple channels which are then processed by digital channel processing modules (DCPM) 421. Each DCPM 421 may operate independently with its own configuration to digitally process a particular channel. The DCPMs 421 may process their channels in parallel.

A signaling/message generator (SMG) 422 captures, reproduces and/or generates voice, text, warning, and/or alert signals (e.g., override signals) to be inserted in one or more communication channels. The break-in signal from the SMG 422 may override the original digital signal in a channel, may be mixed into the original signal in a channel through the DCPM 421, and/or may originate communications with a user terminal over an unused or newly allocated communication channel.

In override mode, the original signal may be replaced with the break-in message signal from the message generator 422. For example, if the intended recipient of an override voice message is having a telephone call with another individual, the conversation would be interrupted and, in its place, the recipient would hear the override voice message. The original telephone call would resume after the break-in message is completed. This allows the recipient to receive notification of an event without permanently disconnecting the original conversation over a channel.

In the mixing mode, the original signal in a channel is combined or mixed with the break-in message signal from the message generator 422. The break-in signal may be mixed at any desired ratio with an original signal in a communication channel, including pass-through or complete override of the original signal. For example, if the recipient of a break-in signal is having a telephone call with another individual, an audible tone (e.g., break-in signal) may be mixed in with the conversation in the communication channel. This allows the recipient to receive notification of an event and still continue the conversation without noticeable interruption.

In origination mode, no overriding or mixing of signals occurs. Instead, the break-in signal is inserted into an unused or available channel between the communication device 400 and a user terminal. In some embodiments where a communication channel has not been previously established or allocated between the communication device 400 and the user terminal, the communication device 400 may be configured to establish such channel by sending control signals to the user terminal.

In various implementations, the break-in signal may be generated by the communication system 400 or by an external signal source. The break-in signal may be prerecorded and/or acquired real-time from an operator, for example.

Each DCPM 421 may also have an output data stream for off-line baseband processing (e.g., demodulation and/or signaling detection) by a receiving baseband processing engine 424 that assists insertion of the break-in signal. For example, the receiving baseband processing engine 424 may ascertain the channel characteristics necessary to properly insert the break-in signal into the channels.

The digital signals from each DCPM 421 may be combined back into one or more digital signals in a channel aggregation module 426. From the channel aggregation module 426, the aggregated digital signal(s) is passed to a high speed/high dynamic range digital-to-analog converter (DAC) 428 to transform the digital signal(s) back to the analog domain (at IF frequency or in-band). From the DAC 428, the analog signals pass to the analog back-end interface 406 for retransmission as an analog RF output 436. A band-pass filter 432 in the analog back-end interface 406 permits that exclusively the band of interest, among all digital replicas, is passed through.

In another aspect of the present invention, a second optional mixer 430*c* may be utilized after the band-pass filter 432 to select between a first and a second operational mode using a selector 430*a*. If the first operational mode is selected, on-band passing of the signal occurs through path 430*b*. If the second operational mode is selected, a frequency translator in path 430*c* is used to center the resulting frequency band on its corresponding RF band.

The power amplifier 435 with variable gain control permits the adjustment of the signal output level. Finally, the signal may be filtered with a second band-pass filter 434 to remove undesirable out-of-band spurious signals. It should be noted that high-speed/high dynamic-range analog-to-digital converters (ADC) and digital-to-analog converters (DAC) provide the analog Intermediate Frequency (IF) gateway into the high processing power reconfigurable DPS 404.

Note that in other implementations, the down-converter and up-converter components may not be needed since processing of the received signals is done in-band. Additionally, the received signals may be in digital form so that the communication device 400 need not perform conversions to and/or from analog.

Figure 5:
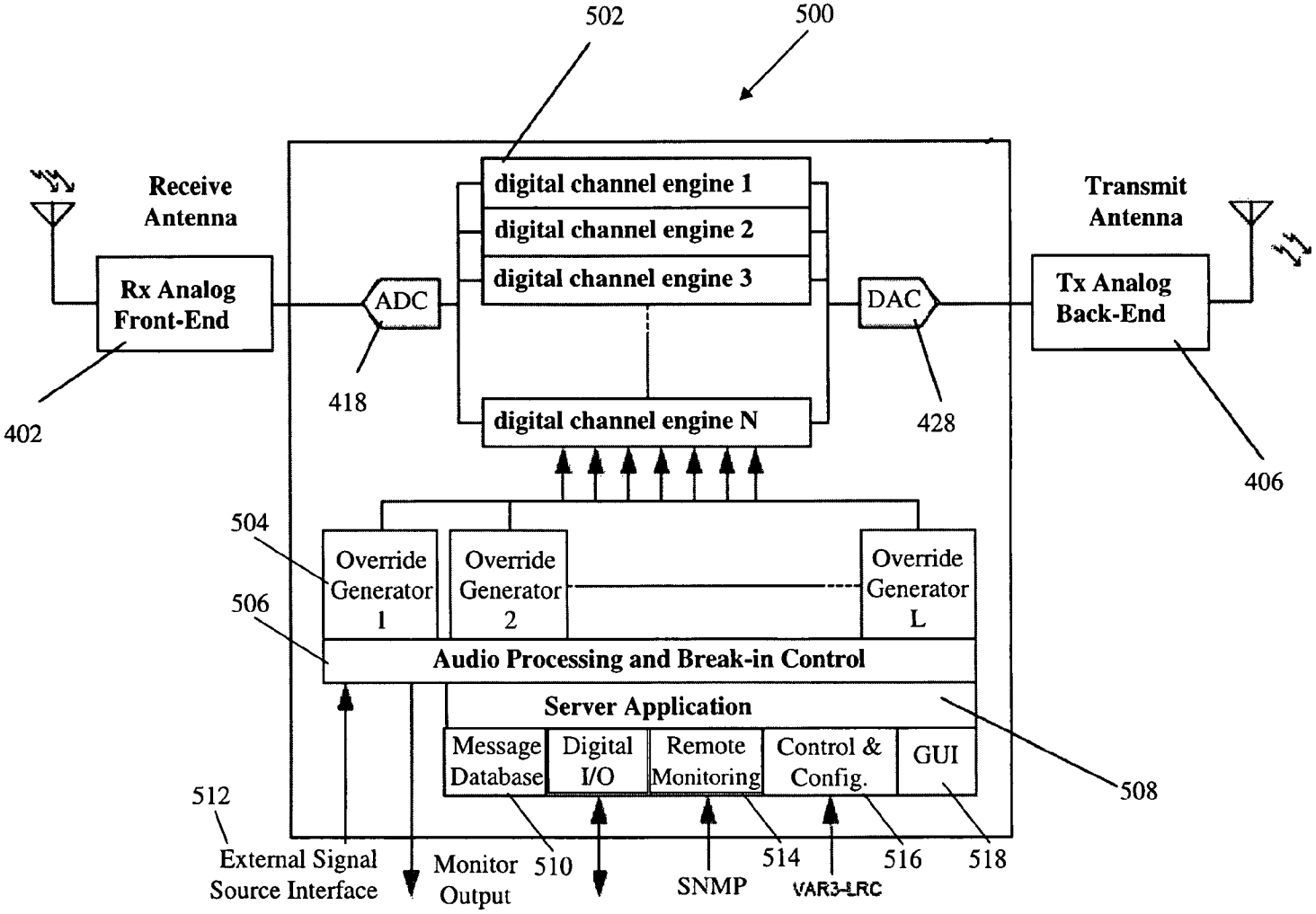
FIG. 5 is a block diagram illustrating an example of functional components of a digital processing system (DPS) configured to provide channel specific signal insertion.

FIG. 5 is a block diagram illustrating an example of functional components of a digital processing system (DPS) configured to provide channel-specific signal insertion. The DPS 500 may include a plurality of channel-specific digital engines 502, as well as one or more override signal generators 504. The digital channel engines 502 may operate (e.g., in parallel) to process different channels by passing content of an original signal through and/or by selectively inserting a break-in signal into one or more of the channels. Each override signal generator 504 may insert a tone, voice, text, and/or data message or signal into one or more of the digital engines 502 under the control of an audio processing and break-in controller 506. The plurality of override signal generators 504 allow different override messages or break-in signals to be broadcasted to different locations (e.g., tunnels, buildings, etc.) simultaneously. For instance, user terminals located in a particular floor of a building may receive a first break-in signal (e.g., evacuation instructions) while user terminals located in a different floor of a building may receive a second break-in signal. The location of user terminals may be ascertained from global positioning information obtained from each user terminal. In another example, different operators (e.g., fire marshal, police chief, paramedics, etc.) may each generate their own separate break-in signals that are distributed to students in a campus via FM radio, AM radio, and/or wireless communication channels.

In one example, the digital channel engines 502 may be implemented as a filter bank, using custom digital down converter (DDCs), digital up converters (DUC), and/or very fast digital filtering approaches to provide low group delay and linear phase response as required by current digital radio systems. Such digital filter bank may be based on reconfigurable hardware providing more reliability and more parallel processing than software-based processing systems. In various implementations, the digital channel engines 502 may allow signal insertion into downlink and/or uplink data and/or control channels.

In some implementations, the digital processing system 500 may obtain location information for user terminals in its vicinity. For example, user terminals may include global positioning systems that allow them to provide location and/or position information. The DPS 500 may obtain this information and use it to target inserted break-in signals to user terminals within a region, location, and/or zone. In this manner, the DPS 500 may rebroadcast signals (pass-through) to some user terminals while transmitting break-in signals to other user terminals.

An onboard server application 508 may manage services that facilitate break-in signal insertion, remote monitoring 514, control and configuration of the DPS 500, and/or a graphical user interface 518. For example, a message database 510 that stores one or more break-in messages may be maintained and accessed to provide a stored break-in message to the one or more override generators 504. Additionally, break-in messages may also be provided from an external source (e.g., microphone, etc.) via an interface 512.

Figure 6:
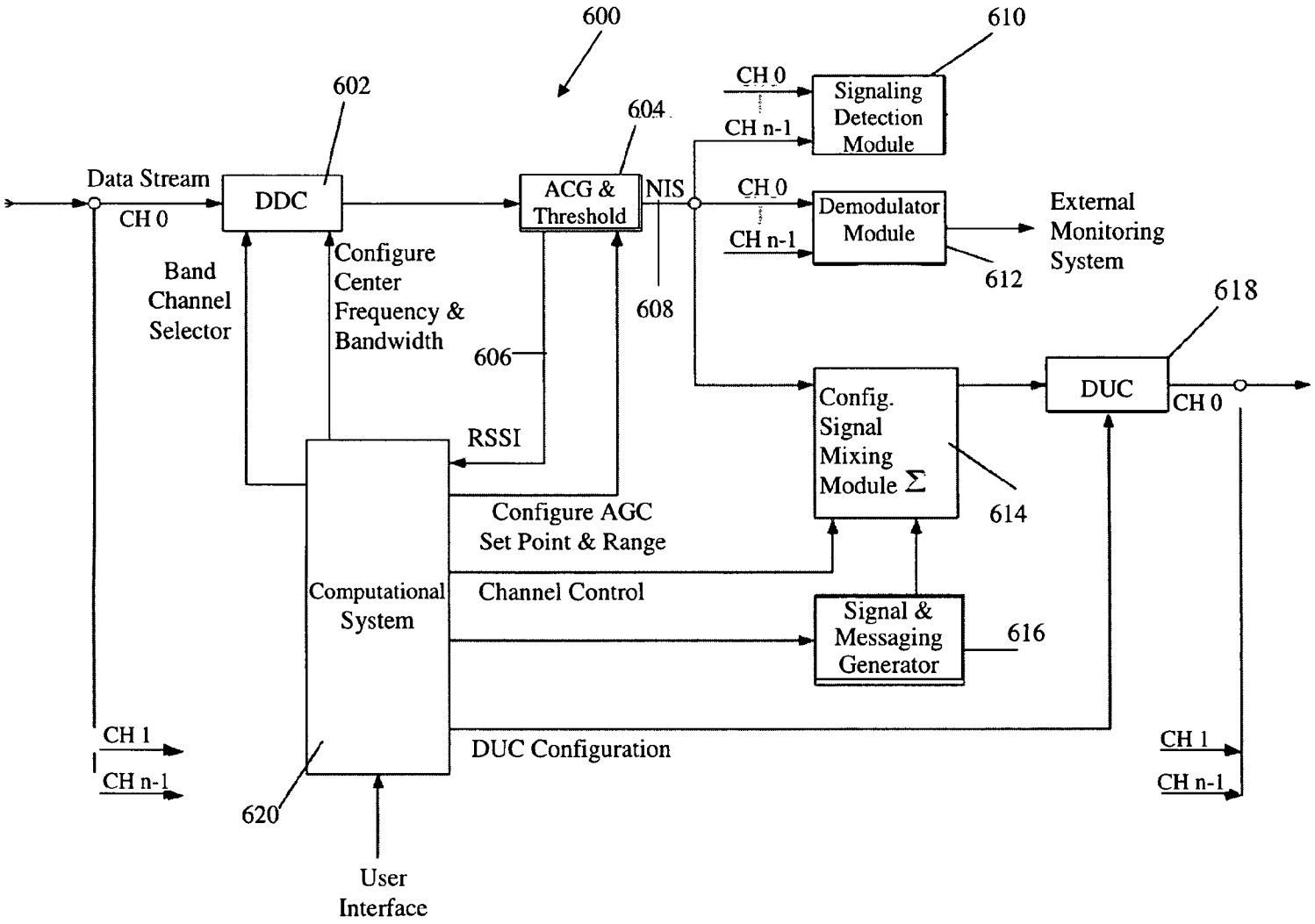
FIG. 6 is a block diagram illustrating functional components of a digital channel processing module.

FIG. 6 is a block diagram illustrating functional components of a digital channel processing module or engine 600. A digital down converter (DDC) 602 is configured to select different channels of the same or different bandwidths based on the requirements of particular applications. The DDC 602 may center a channel of interest at 0 Hz, and reduce the employed sample rate. The output of the DDC 602 is passed to an automatic gain controller (AGC) 604 for normalizing the signal power level to be used, allowing the digital channel engine 600 to manage both strong and weak signals. The AGC 604 is configurable and provides a received signal strength indicator (RSSI) 606 to a processing system 620. From the normalized digital signal 608, particular signalization (e.g., control signals) can be detected by a signaling detection module (SDM) 610. Additionally, the normalized digital signal 608 may be demodulated in a demodulation module 612 for monitoring purposes.

A configurable signal mixing module (CSMM) 614 combines the normalized input signal (NIS) 608, at any desired ratios, with signalization or multimedia messages provided by a signaling/message generator 616. The signaling/message generator 616 may acquire a break-in signal from external sources, internal signal generators or synthesizers, and/or pre-recorded sources. The generated and pre-recorded break-in signal can represent in-band signals or modulated signals as well.

A digital up converter (DUC) 618 interpolates the signal and restores the original signal sample rate, in order to translate the channel to the desired frequency, which can coincide with the frequency at the input of the DDC 602, or can be different frequencies.

Each digital channel processing engine 600 may provide an independent digital channel filter, fully programmable to any radio channel within a band (e.g., per American or European channel spacing).

Figure 7:
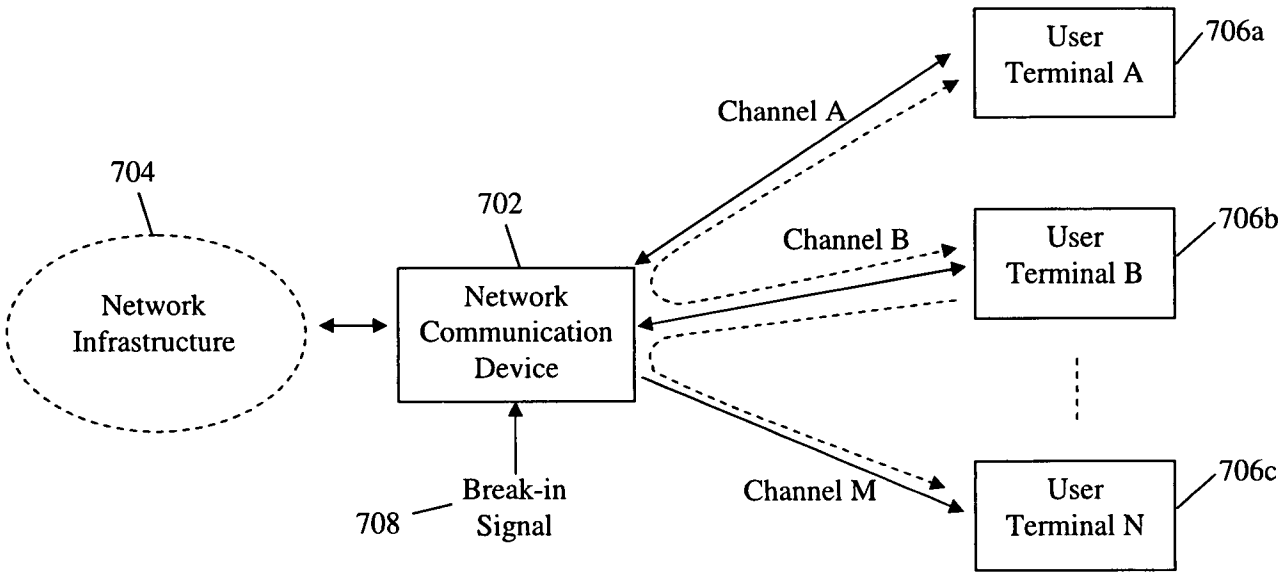
FIG. 7 is a block diagram illustrating how a communication device may be configured to facilitate localized communications with and/or between local user terminals.

FIG. 7 is a block diagram illustrating how a communication device 702 may be configured to facilitate localized communications with and/or between local user terminals. The communication device 702 may be an intermediary network device (e.g., base station, repeater, etc.) that transfers communications between the network 704 and a plurality of user terminals 706.

In one implementation, the channel-specific signal insertion systems and methods described herein permit overriding on-going cellular or wireless telephone calls with a voice, text, tone and/or graphical messages (e.g., emergency messages, pre-recorded messages, live-acquired messages, tones, etc.). The communication device 702 may access particular user terminals 706 (e.g., cellular or wireless phones) with specific break-in signals 708 for each user terminal. In some implementations, the user terminals 706 may be selected by location or phone number, for example. The break-in signals 708 may be broadcasted to specific user terminals (or recipients), to groups of user terminals (or recipients), or to all user terminals over their corresponding communication channel(s), band(s), and/or sub-band(s). Similarly, other types of transmissions (e.g., AM radio, FM radio, analog or digital cable, over-the-air television signals, etc.) may be replaced by break-in multimedia signals (e.g., video, text, graphics, voice, data and/or control signals) that target local user terminals over specific communication channels. For instance, a break-in signal may be inserted into a broadcast channel that can be received by a plurality of user terminals. Alternatively, the break-in multimedia signals may instead be mixed with a signal passing through a communication channel; thus, both the original message and break-in message are sent to a user terminal over a channel.

In another implementation, the communication device 702 (e.g., base station or repeater) may originate communications with a user terminal 706. For example, rather than breaking into an existing communication, the communication device 702 may originate a call to a local user terminal 706 (e.g., mobile phone). For instance, the communication device 702 may detect all cell-phones available in a given area. The communication device 702 may follow the corresponding protocols to start or initiate calls and analyzes the input audio data-stream to decide when to trigger the start of a break-in signal. The communication device 702 may obtain channel information for local user terminals 706 by monitoring control signals (e.g., pings, network control signals, etc.) over a frequency band. It can then use this channel information to send break-in signals (e.g., multimedia and/or control signals) to, and/or receive messages from, one or more user terminals 706. Such messages 708 from the communication device 702 may be pre-recorded or live-acquired. Similarly, other types of transmissions (e.g., AM radio, FM radio, analog or digital cable, over-the-air television signals, etc.) may be initiated by the communication device 702 by using break-in multimedia signals (e.g., video, text, graphics, voice, data and/or control signals) that target local user terminals over available, pre-allocated, and/or newly allocated communication channels.

According to another feature, break-in signal insertion into a channel may be extended to establish bidirectional communications between a communication device 702 (e.g., repeater or base station) and a user terminal 706. That is, rather than sending just a break-in message to a particular user terminal, the communication device 702 may establish bi-directional communications with a user terminal 706*a*. For example, the operator of a communication device 702 (e.g., repeater or base station) may use signal insertion to establish multimedia communications with a user terminal A 706*a*. Since the communication device 702 knows the channel on which the user terminal A communicates, it may insert its break-in signal into the particular digital channel engine (on the downlink path) to send transmissions to the user terminal A 706*a*. Conversely, the communication device 702 may receive communications from the user terminal A 706*a* by monitoring communications on the uplink channel (from the user terminal A to the communication device) to extract messages from the user terminal A 706*a*.

In yet another implementation, a conference call may be established between the communication device 702 (e.g., base station or repeater) and the plurality of user terminals 706. The communication device 702 may identify the one or more communication channels for the plurality of user terminals 706. For example, Channel A is associated with user terminal A 706*a*, Channel B is associated with user terminal B 706*b*, and Channel M is associated with user terminal N 706*c*. Break-in signals 708 (e.g., multimedia signals, control signals, etc.) may be inserted into the downlink path channels (e.g., through the downlink digital channel engines) for one or more of the plurality of user terminals 706. Similarly, the communication device 702 may receive messages (e.g., multimedia signals) from the plurality of user terminals A 706*a* and B 706*b*, for example, on their uplink path channels. The communication device 702 may be configured to relay messages between user terminal A 706*a* (on Channel A) and user terminal B 706*b* (on Channel B) that are part of the conference call. Generally, the communication device 702 may send voice messages/signals to a plurality of user terminals 706 (e.g., mobile phones or radios) over one or more communication channels and also relay messages (e.g., for a conference call) from a first user terminal 706*a* (on Channel A) to one or more other user terminals 706*b* (Channel B) and 706*c* (Channel M). In various implementations, a channel may be uniquely associated with, or allocated to, a particular user terminal or it may be used to broadcast content (e.g., music or voice content) that can be received by a plurality of different user terminals.

In another example, the present invention may allow overriding of the original programming signals (e.g., radio or TV broadcasts) with any selected information for specific recipients. The override can be implemented per channel or per band.

Figure 8:
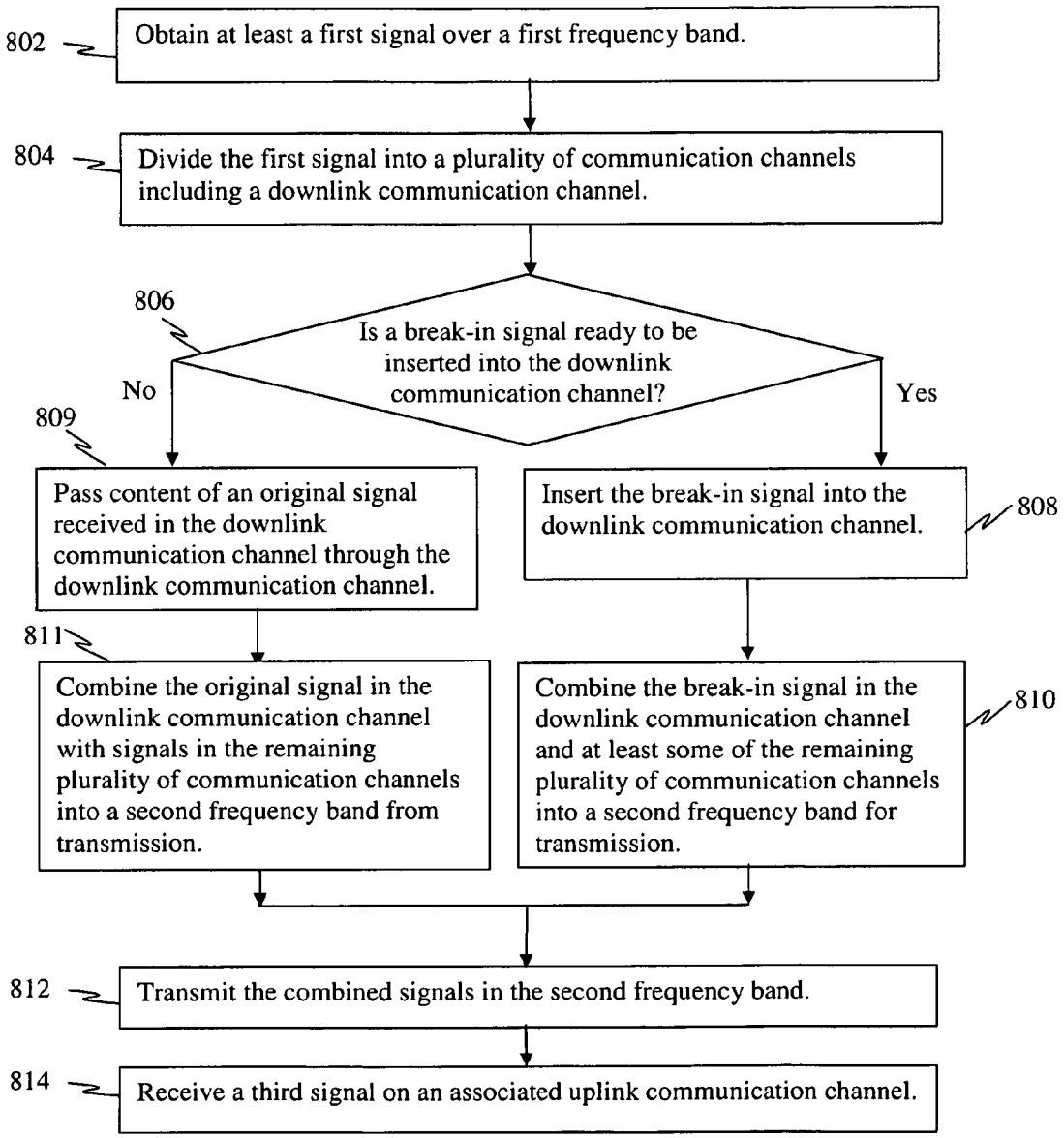
FIGS. 8 and 9 illustrate a flow diagram of exemplary methods operational on a communication device (e.g., base station, repeater, etc.) for facilitating signal insertion to local user terminals.

FIG. 8 is a method operational on a communication device to insert a break-in signal into a channel. In some examples, the communication device may be a base station and/or repeater that serve a plurality of local user terminals. At least a first signal is obtained or received over a first frequency band 802. For example, the communication device may listen for signals on a particular frequency band (e.g., FM radio band, AM radio band, mobile phone radio band, analog/digital cable, etc.). The first signal is divided into a plurality of communication channels including a downlink communication channel 804. For instance, the frequency band may be divided into multiple frequencies, timeslots and/or modulation communication channels. In one example, the downlink communication channel may be a channel that is associated with one or more local user terminals. By monitoring transmissions over the plurality of communication channels, the communication device may ascertain the downlink and/or uplink communication channels associated with particular local user terminals. In another example, the downlink communication channel may simply be a particular channel associated with a broadcast or service provider (e.g., radio station, cable channel, wireless service provider, television station, etc.). In yet another example, an unused, available or newly allocated communication channel may be identified as the downlink communication channel.

A determination is made as to whether a break-in signal is ready to be inserted into the downlink communication channel 806. If no break-in signal is ready, content of an original signal received in the downlink communication channel is passed through the downlink communication channel 809. For example, the original signal in the downlink communication channel may be amplified to a desirable level (and/or normalized) and passed through. The content of the original signal may be combined with signals in the remaining plurality of communication channels into a frequency band for transmission 811.

Otherwise, if a break-in signal is ready to be inserted into the downlink communication channel, the break-in signal is inserted into the downlink communication channel 808. For example, such break-in signal may be a voice message, text message, and/or tone providing a warning, evacuation information, or other message about local conditions or situations. Alternatively, the break-in signal may be a control message that provides setup, configuration, and/or transmission information or instructions to the user terminals. The break-in signal may be generated real-time and/or be pre-stored. Such signal insertion may override an original signal being carried over the downlink communication channel. Alternatively, the break-in signal may be mixed at any desired ratio with an original signal in the communication channel, including pass-through or complete override of the original signal. In yet other implementations, the break-in signal may be inserted into an unused, available, or newly allocated communication channel. The break-in signal in the downlink communication channel may be combined with signals in the remaining plurality of communication channels into a second frequency band for transmission 810. For example, the content and/or signals in the plurality of communication channels may be combined into one or more output signals within the second frequency band.

The combined signals in the second frequency band are then transmitted 812 by the communication device. A third signal may be received on an associated uplink communication channel 814. The third signal may be a response to the break-in signal. In one example, bi-directional communications may be established between the communication device and a first user terminal. Similarly, the communication device may send the same or a different break-in signal (e.g., the same or different message) on the same or different downlink communication channel.

Figure 9:
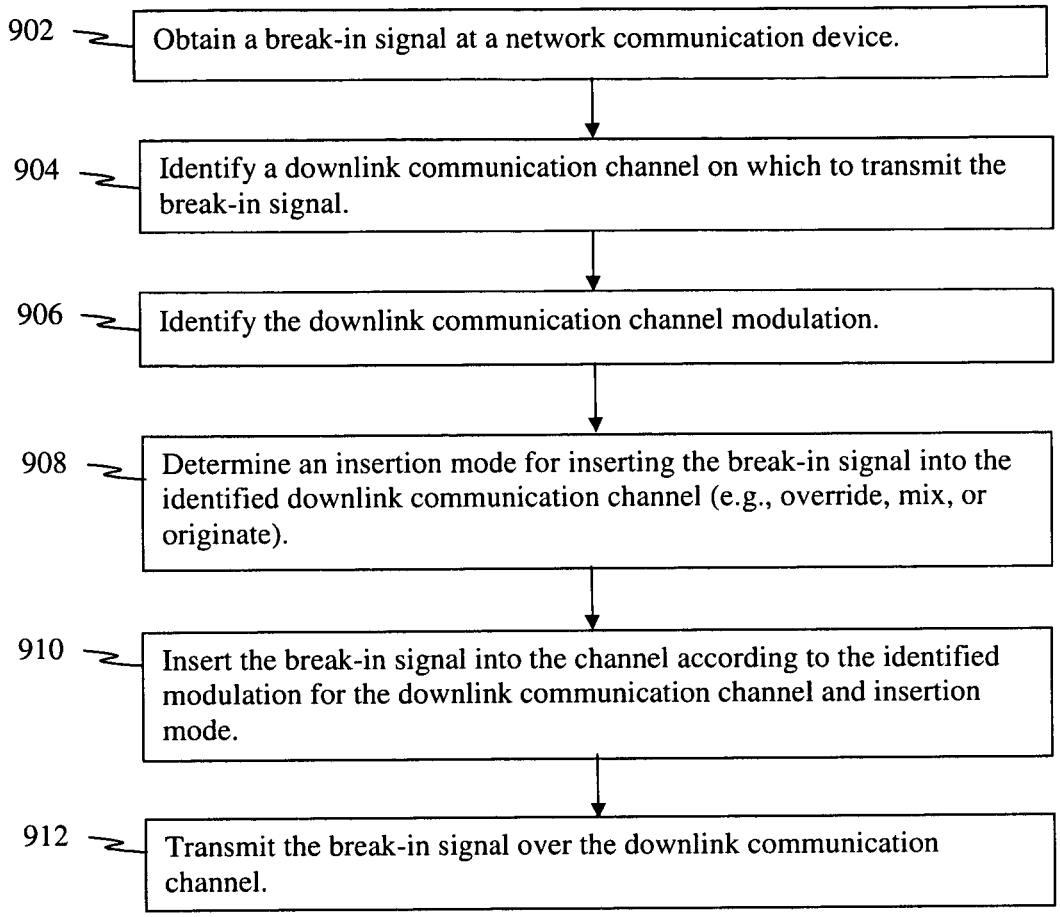

FIG. 9 illustrates a flow diagram of a method operational in a communication device (e.g., base station, repeater, etc.) for facilitating signal insertion to local user terminal. A break-in signal is obtained at a network communication device 902. Such break-in signal may be a multimedia signal and/or control signal that is locally-generated or stored. A downlink communication channel may be identified on which to transmit the break-in signal 904. The downlink communication channel modulation may be identified 906 to determine how the break-in signal may be modulated prior to transmission. A determination is made as to how the break-in signal is to be inserted into the identified downlink communication channel 908. For instance, a determination may be made as to whether the break-in signal should override or mix with an original signal in the downlink communication channel or whether the break-in signal being inserted into an unused or available communication channel. The break-in signal is inserted into the downlink communication channel according to the identified modulation for the downlink communication channel 910. The break-in signal may then be transmitted over the downlink communication channel 912. This allows the local network communication device to insert a break-in signal that carries a message to one or more local user terminals.

One or more of the components, steps, and/or functions illustrated in FIGS. 1, 2, 3, 4, 5, 6, 7, 8 and/or 9 may be rearranged and/or combined into a single component, step, or function or embodied in several components, steps, or functions without affecting the operation of the communication device having channel-specific signal insertion. Additional elements, components, steps, and/or functions may also be added without departing from the invention. The apparatus, devices, and/or components illustrated in FIGS. 1, 2, 3, 4, 5, 6 and/or 7 may be configured to perform one or more of the methods, features, or steps described in FIGS. 8 and/or 9. The novel algorithms described herein may be efficiently implemented in software and/or embedded hardware.

Those of skill in the art would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those ordinarily skilled in the art.

The invention claimed is:

1. A method operational on a wireless repeater adapted to insert break-in signals, comprising:

(a) receiving a plurality of downlink wireless signals at the wireless repeater from one or more network infrastructure devices, each of the plurality of wireless signals comprising a plurality of different downlink communication channels, wherein the plurality of downlink wireless signals are broadcasted by the network infrastructure device to a plurality of mobile user terminals with which bidirectional communication links have been established with the network infrastructure device;

(b) dividing each of the plurality of downlink wireless signals into its plurality of downlink communication channels;

(c) inserting a break-in signal at the wireless repeater into a subset of all channels of the plurality of downlink wireless signals, where the break-in signal includes a marker tone, and insertion of the break-in signal interrupts, replaces, or mixes with an original signal in each of the subset of channels and the break-in signal includes a content message accessible by receiving mobile user terminals as the original signal, wherein the break-in signal is inserted into the wireless repeater by a party independent of an operator of the one or more network infrastructure devices and broadcasters of the plurality of downlink wireless signals; and (d) recombining the plurality of different downlink communication channels, including those with the inserted break-in signals, into the plurality of downlink wireless signals for retransmission.

2. The method of claim 1 wherein different break-in signals having different content are inserted into the subset of the plurality of different downlink communication channels.

3. The method of claim 1 wherein the wireless repeater is distinct from a base station network infrastructure device.

4. The method of claim 1 further comprising:

(a) identifying a modulation for a first communication channel among the plurality of different downlink communication channels;

(b) determining an insertion mode for inserting the break-in signal into the first communication channel; and (c) inserting the break-in signal into the first communication channel according to the identified modulation for the first communication channel and insertion mode.

5. The method of claim 1, further comprising:

establishing, by the wireless repeater, a direct communication channel between two mobile user terminals served by the wireless repeater while bypassing the network infrastructure device.

6. The method of claim 1 further comprising:

receiving a first signal over an uplink communication channel from a first mobile user terminal served by the wireless repeater, the uplink communication channel assigned to the first mobile user terminal, inserting the first signal into a downlink communication channel associated with a second mobile user terminal served by the wireless repeater; and transmitting the first signal as part of the retransmission signal.

7. A wireless repeater configured to facilitate channel-specific insertion of break-in signals, comprising:

a first communication circuit for wirelessly communicating to and from one or more network infrastructure devices;

a second communication circuit for wireless communicating to and from one or more mobile user terminals;

a processing circuit coupled to the first communication circuit and second communication circuit, the processing circuit adapted to (a) receiving a plurality of downlink wireless signals from the one or more network infrastructure devices, each of the plurality of wireless signals comprising a plurality of different downlink communication channels, wherein the plurality of downlink wireless signals are broadcasted by the network infrastructure device to a plurality of mobile user terminals with which bidirectional communication links have been established with the network infrastructure device;

(b) divide each of the plurality of downlink wireless signals into its plurality of downlink communication channels;

(c) insert a break-in signal at the wireless repeater into a subset of all channels of the plurality of downlink wireless signals, where the break-in signal includes a marker tone, and insertion of the break-in signal interrupts, replaces, or mixes with an original signal in each of the subset of channels and the break-in signal includes a content message accessible by receiving mobile user terminals as the original signal, wherein the break-in signal is inserted into the wireless repeater by a party independent of an operator of the one or more network infrastructure devices and broadcasters of the plurality of downlink wireless signals; and (d) recombine the plurality of different downlink communication channels, including those with the inserted break-in signals, into the plurality of downlink wireless signals for retransmission.

8. The wireless repeater of claim 7, wherein the processing circuit is further configured to:

establish, by the wireless repeater, a direct communication channel between two mobile user terminals served by the wireless repeater while bypassing the network infrastructure device.

9. A wireless repeater adapted to insert break-in signals, comprising:

(a) means for receiving a plurality of downlink wireless signals at the wireless repeater from one or more network infrastructure devices, each of the plurality of wireless signals comprising a plurality of different downlink communication channels, wherein the plurality of downlink wireless signals are broadcasted by the network infrastructure device to a plurality of mobile user terminals with which bidirectional communication links have been established with the network infrastructure device;

(b) means for dividing each of the plurality of downlink wireless signals into its plurality of downlink communication channels;

(c) means for inserting a break-in signal at the wireless repeater into a subset of all channels of the plurality of downlink wireless signals, where the break-in signal includes a marker tone, and insertion of the break-in signal interrupts, replaces, or mixes with an original signal in each of the subset of channels and the break-in signal includes a content message accessible by receiving mobile user terminals as the original signal, wherein the break-in signal is inserted into the wireless repeater by a party independent of an operator of the one or more network infrastructure devices and broadcasters of the plurality of downlink wireless signals; and (d) means for recombining the plurality of different downlink communication channels, including those with the inserted break-in signals, into the plurality of downlink wireless signals for retransmission.

10. The wireless repeater of claim 9, further comprising: means for establishing, by the wireless repeater, a direct communication channel between two mobile user terminals served by the wireless repeater while bypassing the network infrastructure device.

11. The method of claim 1, wherein the wireless repeater is restricted to serving mobile user terminals within a particular structure.

12. The method of claim 11, wherein the structure is one of a tunnel or a building.

13. The method of claim 1, wherein the both the content message and original signal are received and accessible by the receiving mobile user terminals.

14. The wireless repeater of claim 7, wherein different break-in signals having different content are inserted into the subset of the plurality of different downlink communication channels.

15. The wireless repeater of claim 7, wherein the processing circuit is further configured to:

(a) identify a modulation for a first communication channel among the plurality of different downlink communication channels;

(b) determine an insertion mode for inserting the break-in signal into the first communication channel; and (c) insert the break-in signal into the first communication channel according to the identified modulation for the first communication channel and insertion mode.

16. The wireless repeater of claim 7, wherein the processing circuit is further configured to:

receive a first signal over an uplink communication channel from a first mobile user terminal served by the wireless repeater, the uplink communication channel assigned to the first mobile user terminal;

insert the first signal into a downlink communication channel associated with a second mobile user terminal served by the wireless repeater; and transmit the first signal as part of the retransmission signal.

* * * * *